US005878591A

United States Patent [19]

Tsuji et al.

[11] Patent Number: 5,878,591

[45] Date of Patent: Mar. 9, 1999

[54] AIR CONDITIONER

[75] Inventors: Taii Tsuji; Masaharu Ebihara, both of Shiga, Japan

[73] Assignee: Matsushita Electric Industrial Co., Ltd., Osaka, Japan

[21] Appl. No.: 972,252

[22] Filed: Nov. 18, 1997

[30] Foreign Application Priority Data

Nov. 19, 1996 [JP] Japan ..... 8-307680

[51] Int. Cl.[6] ..... F25D 21/14

[52] U.S. Cl. ..... 62/285; 62/411

[58] Field of Search ..... 62/262, 272, 285, 62/286, 288, 290, 291, 404, 408, 409, 411; 454/299, 314, 316, 328

[56] References Cited

U.S. PATENT DOCUMENTS

| | | | |
|---|---|---|---|
| 3,750,418 | 8/1973 | Maudlin | 62/290 |
| 4,385,505 | 5/1983 | Umezu et al. | 62/285 |
| 4,782,999 | 11/1988 | Ishii et al. | 236/49 |
| 4,924,939 | 5/1990 | Kim | 165/172 |
| 5,194,043 | 3/1993 | Takahashi et al. | 454/316 |

*Primary Examiner*—William Doerrler
*Attorney, Agent, or Firm*—McDermott, Will & Emery

[57] ABSTRACT

An air conditioner with a direction changing device enabling safe handling of condensed water without causing reduction in direction changing capacity in a cooling-mode operation is provided. The air conditioner comprises a main body, air conditioning members provided in the main body for achieving a function of conditioning the air, an outlet grille located in a front side of the main body for directing air from inside the main body to outside the main body and a lateral flap placed in an opening of the outlet grille for changing the direction of air in the lateral direction. A part of the lateral flap is held by a mounting shaft. The lateral flap can be pivotally moved in the lateral direction about the mounting shaft. A convex portion is provided in a downwind end of the lateral flap. When the end portion of the lateral flap is moved either in the right or left direction, condensed water adhered to the lateral flap is gathered at the convex portion, then the condensed water gathered at the convex portion is transferred to a wall of the outlet grille, and flows out of a room through the main body of air conditioner.

13 Claims, 9 Drawing Sheets

PRIOR ART

PRIOR ART

AIR CONDITIONER

FIELD OF THE INVENTION

The present invention relates to an air conditioner, particularly, a direction changing device for changing the direction of air from an indoor unit.

BACKGROUND OF THE INVENTION

In an air direction changing device of a conventional air conditioner, an end surface of a lateral flap provided in an outlet grille is cut off for handling condensed water during a cooling-mode operation.

A conventional direction changing device is described below by referring to the drawings.

As shown in FIG. 8, a vertical flap ill is located in an opening of an outlet grille 102 in an air conditioner 110, and a plurality of lateral flaps 101 linked with each other in an upwind side by a linking bridge are provided. As shown in FIG. 9, an end portion 104 located in the downwind side of a mounting shaft 103 of the lateral flap 101 is cut off for handling condensed water 106 during a cooling-mode operation.

However, with the conventional lateral flap 101 of such shape, when the lateral flap 101 is moved in the lateral direction during a cooling-mode operation, condensed water 106 is condensed in a surface of the lateral flap 101, as shown in FIG. 9. If the condensed water 106 drops outside from the opening of outlet grille, the condensed water 106 falls inside a room where the air conditioner 110 is placed. In order to solve this problem, the end portion 104 of lateral flap 101 in a downwind side of the mounting shaft 103, provided in a lower part of the outlet grille 102, is cut off. In this manner, the condensed water 106 adhered to the lateral flap 101 is guided toward the mounting shaft 103, moves along a lower portion of the outlet grille 102, and flows into a water collecting groove 108 in a front frame 107. However, this design incurs operating deficiencies because the lateral flap 101 is reduced in capacity of direction change, which is a primary function it should achieve, if a cut-off amount of the end portion 104 is significant. Also, if a cut-off amount of the end portion 104 is insignificant, the condensed water 106 falls inside a room.

It is an object of the present invention to solve these problems, and provide a lateral direction changing device for safely handling condensed water without reducing the direction changing capacity in a cooling-mode operation.

It is another object of the invention to provide a lateral direction changing device assuring no reduction in direction changing capacity in any operating mode of an air conditioner.

SUMMARY OF THE INVENTION

An air conditioner according to the invention comprises: a main body; air conditioning members provided in the main body for achieving a function of supplying cool air; an outlet grille located in a front side of the main body for supplying the cool air from inside to outside; and a lateral flap placed in an opening of the outlet grille for changing the direction of air in the lateral direction.

A part of the lateral flap is held by a mounting shaft, and the lateral flap can be pivotally moved in the lateral direction about the mounting shaft, a convex portion is provided in a downwind end of the lateral flap, and condensed water adhered to the lateral flap is gathered at the convex portion, and flows along a wall of the outlet grille.

It is particularly desirable that the convex portion in the lateral flap is an extension formed by extending the end portion of lateral flap in the downwind direction.

It is particularly desirable that a distance between the convex portion of the lateral flap and the wall of outlet grille and a shape of the outlet grille are predetermined for allowing the convex portion of the lateral flap to approach the wall of outlet grille without touching it when the convex portion of lateral flap is moved in the lateral direction.

It is particularly desirable that the lateral flap is provided with plural flap elements, and each one of the plural lateral flap elements is formed with the convex portion.

It is particularly desirable that a groove is provided below the wall of outlet grille, and the condensed water flowing along a side of the wall of outlet grille is discharged out of the main body through the groove.

It is particularly desirable that a vertical flap is provided in the downwind side of the lateral flap for changing the direction of air in the vertical direction.

It is particularly desirable that a quantity of air received by the lateral flap is increased by the convex portion, when the convex portion of lateral flap is moved in the lateral direction, and a direction controlling efficiency is thereby increased.

One of the advantages of the present invention, according to the construction described above, is that condensed water adhered to the lateral flap can be safely discharged outdoors through the main body without falling inside a room.

Another advantage of the present invention is that within a moving range of the lateral flap in any of the heating, drying and ventilation modes of operation, the reduction in direction changing capacity is avoided, which normally occurs in conventional air conditioners caused by cutting-off of the end surface of lateral flap.

The invention itself, together with further objects and attendant advantages, will best be understood by reference to the following detailed description taken in conjunction with the accompanying drawings.

DETAILED DESCRIPTION OF THE INVENTION

Figure 1:
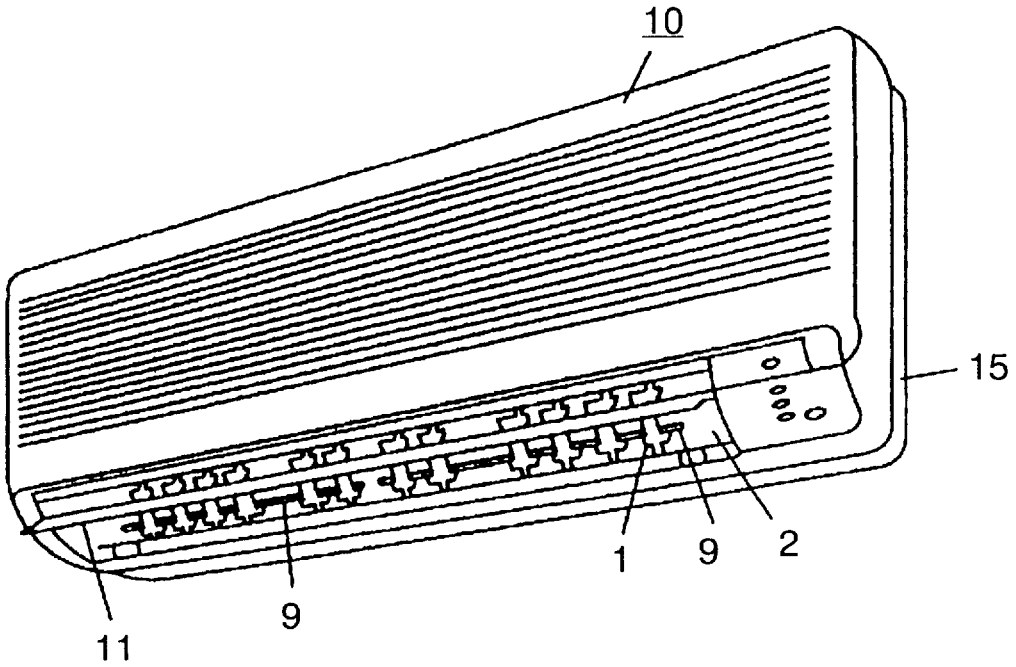
FIG. 1 is a perspective view of an air conditioner having a direction changing device according to the invention.

Embodiments of the air conditioner employing a direction changing device according to the present invention are described below by referring to the drawings.

Embodiment 1

Figure 2:
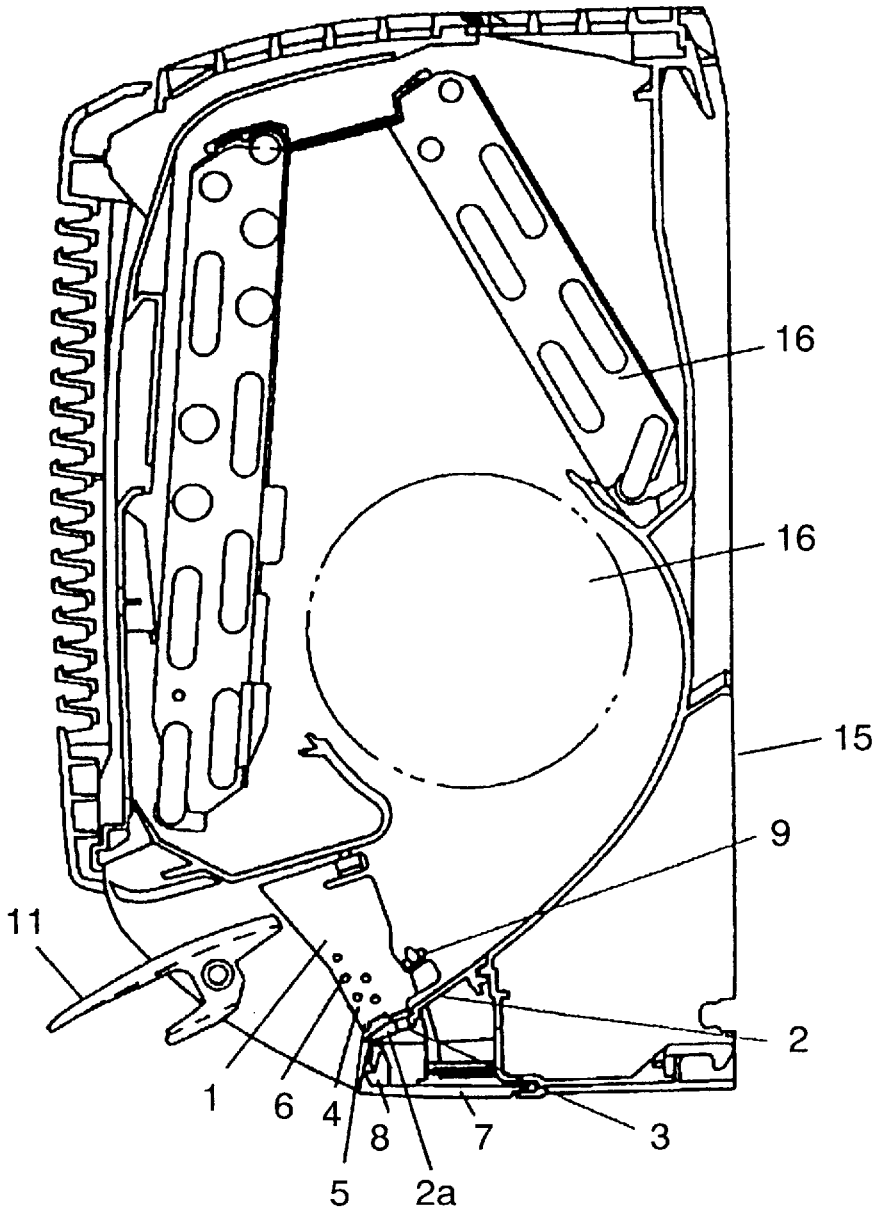
FIG. 2 is a sectional view of an air conditioner having a direction changing device according to the invention.
Figure 3:
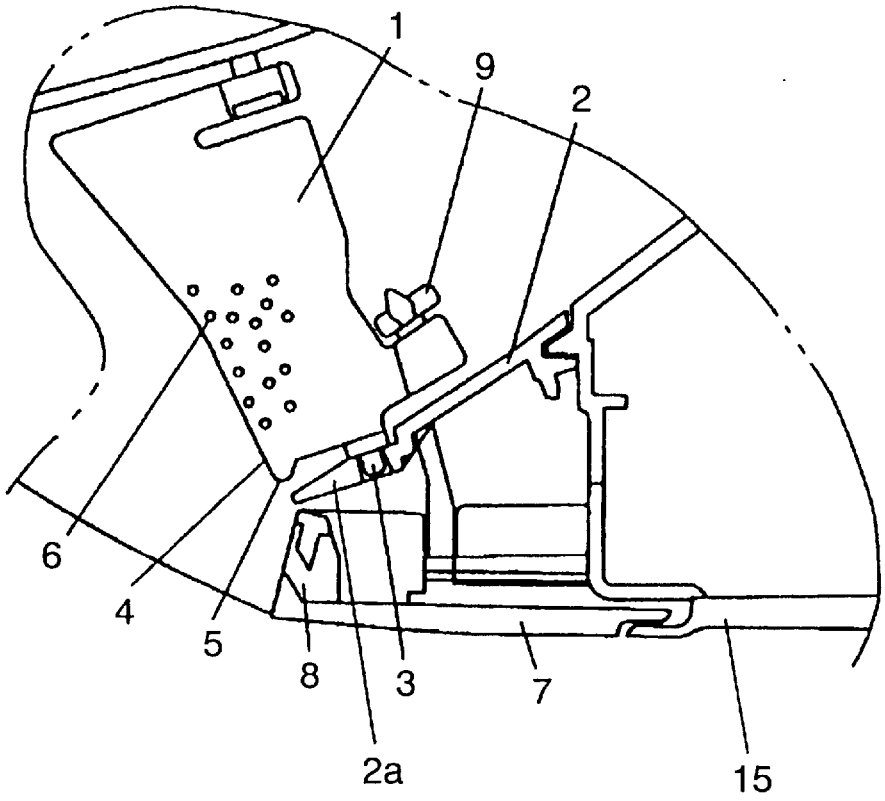
FIG. 3 is a sectional view of a main part of an opening of an outlet grille, showing a first embodiment of a direction changing device for an air conditioner according to the invention.
Figure 4:
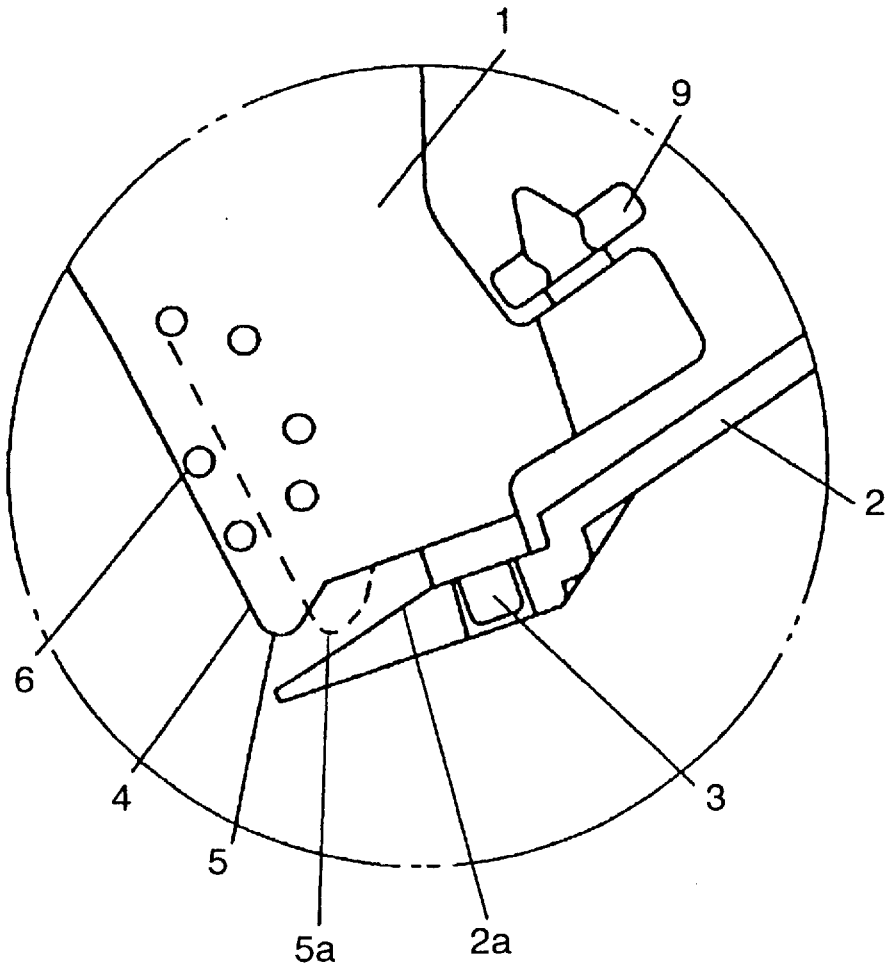
FIG. 4 is a sectional view of a main part of an opening of an outlet grille in the direction changing device shown in FIG. 3.
Figure 7:
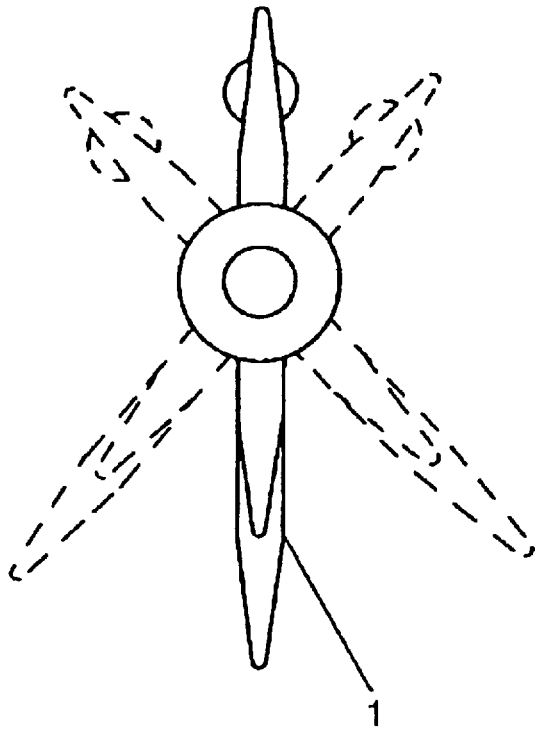
FIG. 7 is a top plan view showing a movable range of a lateral flap provided in a direction changing device.
Figure 8:
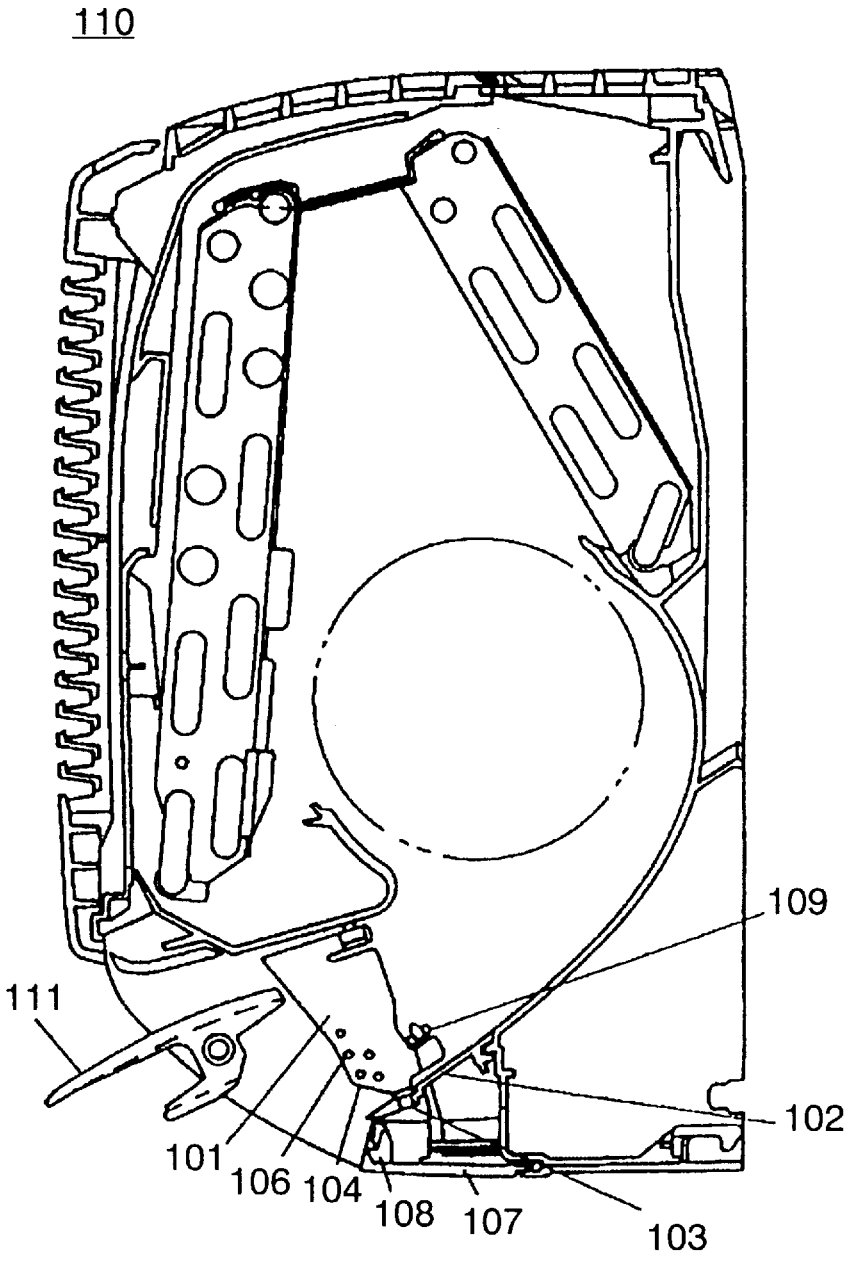
FIG. 8 is a sectional view of a conventional air conditioner.
Figure 9:
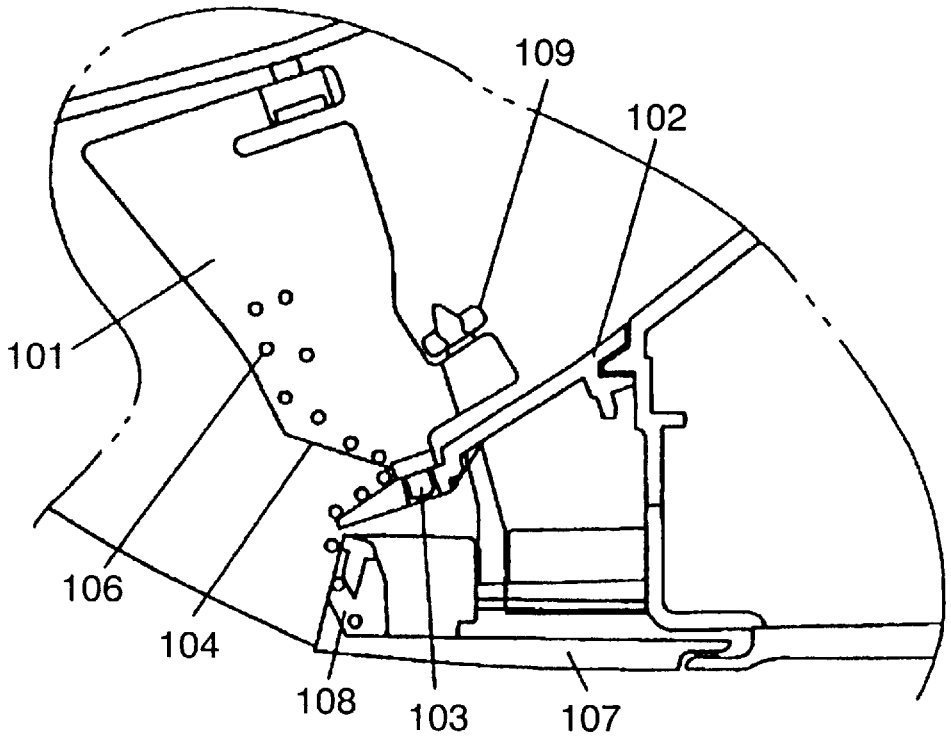
FIG. 9 is a sectional view of a main part of an opening of an outlet grille in a conventional air conditioner.

FIGS. 1 and 2 are perspective and sectional views of an air conditioner employing a direction changing device according to the invention. FIGS. 3 and 4 are magnified sectional views of the vicinity of an outlet grille in the air conditioner shown in FIG. 2. FIG. 7 is a top plan view showing a movable range of a lateral flap used in a direction changing device according to the invention.

In FIGS. 1 and 2, such air conditioning members 16, acting as a heat exchanger and a fan, are placed inside a main body 15 of an air conditioner 10, and an outlet grille 2 is provided in a lower part of a front side of the air conditioner 10. In an opening of the outlet grille 2, a vertical flap 11 for changing the direction of air in the vertical direction is employed. In an upwind side of the vertical flap 11, a lateral flap 1 for changing the direction of air in the lateral direction is located, and the lateral flap 1 is provided with plural flap elements which are linked with each other by a linking bridge 9, respectively.

In FIGS. 2, 3 and 4, a part of the lateral flap 1 is attached to the main body 15 of air conditioner 10 by a mounting shaft 3. A convex portion 5 is formed in an end portion 4 in a lower part of the lateral flap 1. The convex portion 5 is adapted to be in the lowest level when the air conditioner 10 is installed in a room. The convex portion 5 is located in the downwind side in relation to the mounting shaft 3. The main body 15 of air conditioner 10 has a frame 7 in a lower part thereof, and a groove 8 for handling water is provided in the frame 7. The groove 8 is connected to a drain (not shown) for discharging water that has accumulated inside the main body of the air conditioner to the outside of the room. A wall of the outlet grille 2, located below the convex portion 5 of the lateral flap 1, is provided with a lower portion 2*a* having an angled shape. The lateral flap 1 is pivotally movable over a predetermined angle in the lateral direction about the mounting shaft 3. The distance between the lateral flap 1 and outlet grille 2, and the angle of inclination of the lower portion 2*a* of outlet grille 2 are predetermined for allowing the convex portion 5 of the lateral flap 1 to approach the lower portion 2*a* of the outlet grille 2 without touching it when the lateral flap 1 is moved. The groove 8 described above is positioned below the lower portion 2*a* of outlet grille 2. The convex portion 5 formed in the end portion 4 of the lateral flap 1 is shaped such that the condensed water 6 adhered to the lateral flap 1 is gathered at the convex portion 5. The convex portion 5 may be provided by, for example, an extension formed by extending the end portion 4 of lateral flap 1. Alternatively, the convex portion 5 may be employed by, for example, a convex member placed on the end portion 4 of lateral flap 1.

In a cooling-mode operation of this embodiment, the lateral flap 1 is rotated from a position shown by a solid line to a position shown by a broken line in FIG. 7, so that the direction of cool air produced by the apparatus members 16 incorporated in the main body 15 is changed in the lateral direction. When a turbulence is caused in the air, condensed water 6 is adhered to a surface of the lateral flap 1. As such, the condensed water 6 flows toward the end portion 4 of the lateral flap 1 located in the downwind direction, and the condensed water 6 is accumulated, and gathered at the convex portion 5. At which time, the convex portion 5 has already been moved from the position shown by a solid line to the position shown by a broken line in FIG. 7, and is positioned closely to the lower portion 2*a* of the outlet grille 2, as shown by a broken line 5*a* in FIG. 4, because an inclined surface is provided in the lower portion 2*a* of the outlet grille 2. A distance between the convex portion 5 and lower portion 2*a* of the outlet grille 2 is predetermined such that the condensed water 6 is swiftly moved to the lower portion 2*a* of outlet grille 2 when the condensed water 6 reaches the convex portion 5.

The condensed water 6 gathered at the convex portion 5 is transferred to the lower portion 2*a* of outlet grille 2, when the convex portion 5 approaches the lower portion 2*a* of outlet grille 2, and flows down to the groove 8 formed in the front frame 7. In this regard, the condensed water 6 gathered at the convex portion 5 is transferred to the lower portion 2*a* of the outlet grille 2 by a wind force provided by the cool air. Alternatively, the condensed water 6 gathered at the convex portion 5 may be brought into contact with the lower portion 2*a* when the convex portion 5 approaches the lower portion 2*a* of outlet grille 2.

As a result, an advantage associated with this embodiment is that the condensed water 6 is prevented from dropping outside from the opening of the outlet grille in the front side, thereby avoiding the outflow of the condensed water 6 inside a room.

Embodiment 2

Embodiment 2 of the invention is now described.

Figure 5:
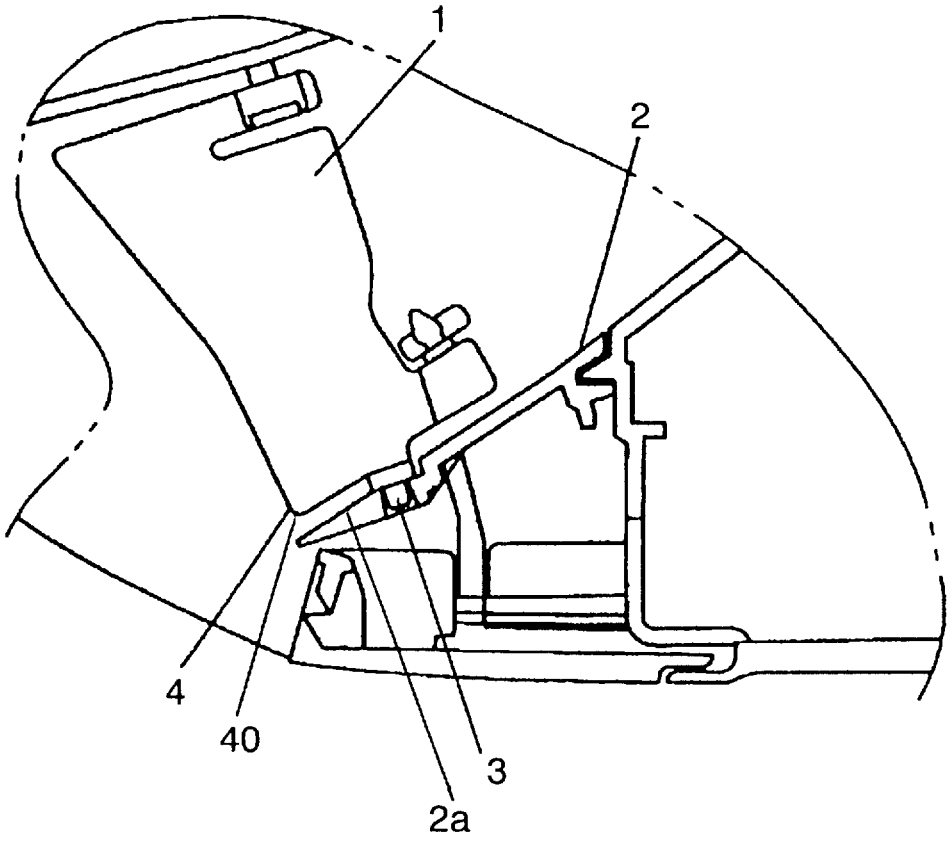
FIG. 5 is a sectional view of a main part of an opening of an outlet grille, showing a second embodiment of a direction changing device for an air conditioner according to the invention.
Figure 6:
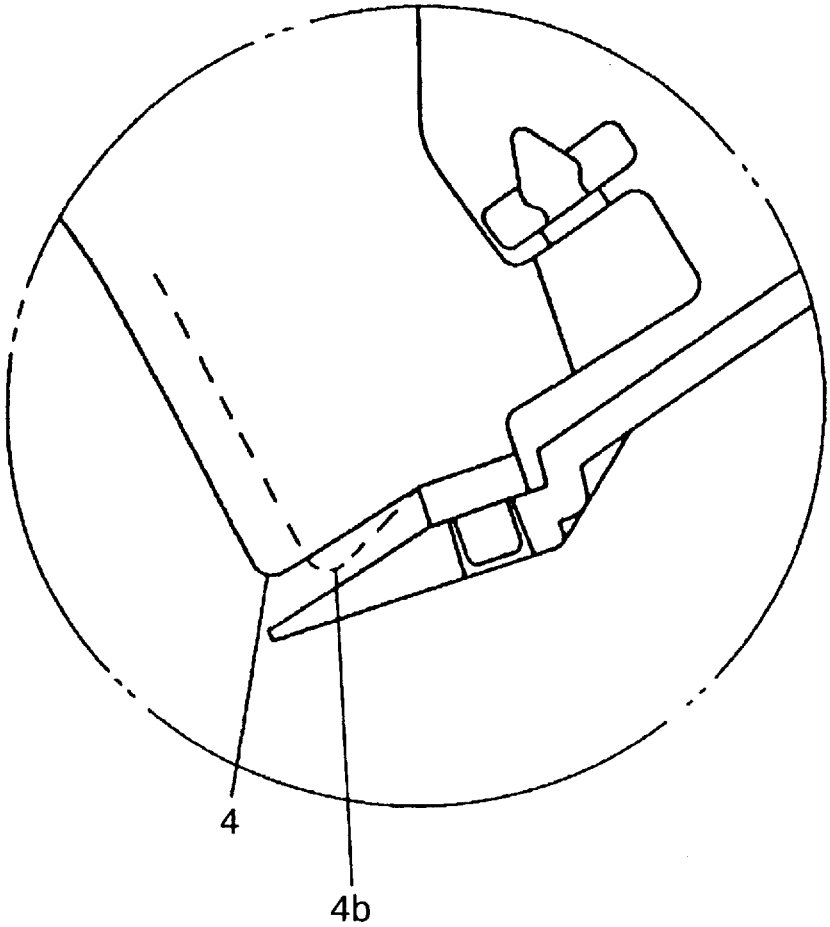
FIG. 6 is a sectional view of a main part of an opening of an outlet grille in the direction changing device shown in FIG. 5.

FIGS. 5 and 6 are sectional views of a main part of an outlet grille in an air conditioner according to a second embodiment of the invention. In FIGS. 5 and 6, instead of being in a cut-out shape, an end portion 4 of a lateral flap 1 is provided with an extension 40 extending upwind from the end portion 4. Other parts are identical with those of Embodiment 1. In FIGS. 5 and 6, when the end portion 4 of the lateral flap 1, which is in the downwind side of a mounting shaft in a lower portion 2*a* of an outlet grille 2, approaches an inclined surface of the lower portion 2*a* of outlet grille 2, and the lateral flap 1 is moved to a position shown by a broken line in FIG. 7, the end portion 4 is located in a position shown by a broken line in FIG. 6. In this embodiment, the positioning of the lateral flap 1 is predetermined such that the extension 40 of the end portion 4 never touches the lower portion 2*a* of outlet grille 2 so as to avoid the problems and deficiencies associated with conventional designs, as discussed above. It is particularly desirable that condensed water 6 gathered at the extension 40 is brought into contact with the lower portion 2*a* when the extension 40 approaches the lower portion 2*a* of outlet grille 2.

In this embodiment, when the extension 40 of the lateral flap 1 is moved closely to the lower portion 2*a* of outlet grille 2, the condensed water 6 accumulated to the extension 40 is transferred to the outlet grille 2, and flows down to a groove 8. As a result, outflow of the condensed water 6 from an opening of the outlet grille 2 in the front side to inside a room is avoided. Further, because the end portion 4 is not cut out, reduction in quantity of air received by the lateral flap can be prevented, and reduction in direction changing capacity is accordingly avoided in all operating modes including heating, drying and ventilation modes.

As clearly shown in above Embodiments 1 and 2, an advantage associated with the present invention is that by providing a convex portion or extension in a lateral flap, condensed water can be safely handled without being allowed to drop inside a room.

As yet another advantage associated with the above embodiments 1 and 2, by providing an end surface of lateral flap near an inclined surface of a lower portion of the outlet grille, condensed water can be safely handled in a cooling-mode operation of an air conditioner without causing leakage into the a room. Therefore, a reduction in direction changing capacity, caused by cutting-off of the end surface of lateral flap, can be avoided for the movable range of lateral flap in all operating modes including heating, drying and ventilation modes.

Of course, it should be understood that a wide range of changes and modifications can be made to the preferred embodiment described above. It is therefore intended that the foregoing detailed description be understood that it is the following claims, including all equivalents, which are intended to define the scope of this invention.

We claim:

1. An air conditioner comprising:

a main body;

air conditioning members disposed in said main body for supplying cool air;

an outlet grille located in a front side of said main body for directing the cool air supplied from said air conditioning members inside said main body to outside said main body; and a lateral flap placed in an opening of said outlet grille for changing the direction of air in the lateral direction, wherein a part of said lateral flap being held by a mounting shaft, said lateral flap having an upwind end and downwind end relative to the direction of the cool air supplied and pivotally movable in the lateral direction about said mounting shaft, a convex portion being provided in the downwind end of said lateral flap, and wherein condensed water adheres to said lateral flap gathered at said convex portion, and flows along a wall of said outlet grille, said wall of the outlet grille being formed with an inclined surface, and the condensed water gathered at said convex portion flows along said wall.

2. An air conditioner comprising:

a main body;

air conditioning members disposed in said main body for supplying cool air;

an outlet grille located in a front side of said main body for directing the cool air supplied from said air conditioning members inside said main body to outside said main body; and a lateral flap placed in an opening of said outlet grille for changing the direction of air in the lateral direction, wherein a part of said lateral flap being held by a mounting shaft, said lateral flap having an upwind end and downwind end relative to the direction of the cool air supplied and Pivotally movable in the lateral direction about said mounting shaft, a convex Portion being provided in the downwind end of said lateral flap, and wherein condensed water adheres to said lateral flap gathered at said convex portion, and flows along a wall of said outlet grille, wherein the condensed water gathered at said convex portion being transferred to said wall by a wind force of the cool air.

3. An air conditioner comprising:

a main body;

air conditioning members disposed in said main body for supplying cool air;

an outlet grille located in a front side of said main body for directing the cool air supplied from said air conditioning members inside said main body to outside said main body; and a lateral flap placed in an opening of said outlet grille for changing the direction of air in the lateral direction, wherein a part of said lateral flap being held by a mounting shaft, said lateral flap having an upwind end and downwind end relative to the direction of the cool air supplied and pivotally movable in the lateral direction about said mounting shaft, a convex portion being provided in the downwind end of said lateral flap, and wherein condensed water adheres to said lateral flap gathered at said convex portion, and flows along a wall of said outlet grille, wherein a groove being provided below said wall of the outlet grille, and the condensed water flowing along a side of said wall of the outlet grille being discharged out of said main body through said groove.

4. An air conditioner of claim 1, 2 or 3, wherein a distance between said convex portion of the lateral flap and said wall of the outlet grille and a shape of said outlet grille are predetermined for allowing said convex portion of the lateral flap to approach said wall of the outlet grille without touching said wall when said convex portion of the lateral flap is moved in the lateral direction.

5. An air conditioner of claim 1, 2 or 3, wherein said convex portion provided in said lateral flap being an extension formed by extending the end portion of the lateral flap in the downwind direction.

6. An air conditioner of claim 1, 2 or 3, wherein said lateral flap being provided with plural flap elements, and each one of said plural flap elements being formed with said convex portion.

7. An air conditioner of claim 1, 2 or 3, further comprising a vertical flap being provided in the downward side of said lateral flap for changing the direction of air in the vertical direction.

8. An air conditioner of claim 1, 2 or 3, wherein a quantity of air received by said lateral flap being increased by said convex portion, when the end portion of the lateral flap moves in the lateral direction, and thereby increases direction controlling efficiency.

9. An air conditioner comprising:

a main body;

air conditioning members disposed in said main body for supplying cool air;

an outlet grille located in a front side of said main body for directing the cool air supplied from said air conditioning members inside said main body to outside said main body; and a lateral flap placed in an opening of said outlet grille for changing the direction of air in the lateral direction, wherein a part of said lateral flap being held by a mounting shaft, said lateral flap having an upwind end and downwind end relative to the direction of the cool air supplied and pivotally movable in the lateral direction about said mounting shaft, a convex portion being provided in the downwind end of said lateral flap, and wherein a quantity of air received by said lateral flap being increased by said convex portion, when said convex portion of lateral flap moves in the lateral direction, thereby increasing direction controlling efficiency, wherein said outlet grille being provided with a wall having an inclined surface, and condensed water adheres to said lateral flap, gathers at said convex portion, and flows to said wall.

10. An air conditioner of claim 9, wherein said convex portion provided in said lateral flap being an extension formed by extending the end portion of the lateral flap in the downwind direction.

11. An air conditioner of claim 9, wherein a distance between said convex portion of said lateral flap and said wall of the outlet grille and a shape of said outlet grille are predetermined for allowing said convex portion of the lateral flap to approach said wall of the outlet grille without touching it when the end portion of the lateral flap moves either in the right or left direction.

12. An air conditioner of claim 9, wherein said lateral flap being provided with plural flap elements, and each one of said plural flap elements being formed with said convex portion.

13. An air conditioner of claim 9, further comprising a vertical flap that being provided in the downwind side of said lateral flap for changing the direction of air in the vertical direction relative to said lateral flap.

* * * * *